US005301851A

United States Patent [19]

Frutin

[11] Patent Number: 5,301,851

[45] Date of Patent: Apr. 12, 1994

[54] GAS STORAGE AND DISPENSING SYSTEM

[75] Inventor: Bernard D. Frutin, Glasgow, United Kingdom

[73] Assignee: Rocep-Lusol Holdings Limited, Great Britain

[21] Appl. No.: 843,079

[22] Filed: Mar. 2, 1992

[30] Foreign Application Priority Data

Mar. 2, 1991 [GB] United Kingdom ..... 9104458
Mar. 16, 1991 [GB] United Kingdom ..... 9105608

[51] Int. Cl.[5] ..... B65D 83/14; F17C 11/00

[52] U.S. Cl. ..... 222/389; 222/396; 222/386.5; 239/53

[58] Field of Search ..... 222/386.5, 394, 396, 222/399, 95, 3, 402.1, 389; 239/53-57; 169/78, 11, 30, 31; 431/344; 62/45.1, 48.1; 55/74, 316

[56] References Cited

U.S. PATENT DOCUMENTS

| | | | |
|---|---|---|---|
| 3,122,284 | 2/1964 | Miles | 222/399 |
| 3,128,922 | 4/1964 | Kuster | 222/389 |
| 3,189,231 | 6/1965 | Kibbel, Jr. et al. | 222/389 |
| 3,813,041 | 5/1974 | Kleine | 239/55 |
| 3,950,960 | 4/1976 | Kawam | 222/3 X |
| 4,023,701 | 5/1977 | Dockery | 220/457 X |
| 4,049,158 | 9/1977 | Lo et al. | 222/399 X |
| 4,182,688 | 1/1980 | Murtaugh | 222/3 X |
| 5,032,619 | 7/1991 | Frutin et al. | 222/399 X |
| 5,151,093 | 9/1992 | Theeuwes et al. | 222/389 X |
| 5,165,572 | 11/1992 | Bath | 222/389 |

FOREIGN PATENT DOCUMENTS

| | | |
|---|---|---|
| 0385773 | 3/1990 | European Pat. Off. . |
| 1400708 | 1/1963 | Fed. Rep. of Germany . |
| 3721099 | 5/1986 | Fed. Rep. of Germany . |
| 3442014 | 1/1989 | Fed. Rep. of Germany . |
| 2154816 | 5/1973 | France . |
| 2247668 | 5/1975 | France . |
| 2596139 | 2/1987 | France . |
| 1303378 | 1/1973 | United Kingdom . |
| 1358357 | 7/1974 | United Kingdom . |
| 1542322 | 3/1977 | United Kingdom . |
| 2096245 | 10/1982 | United Kingdom . |
| 2108517 | 5/1983 | United Kingdom . |

*Primary Examiner*—Andres Kashnikow
*Assistant Examiner*—Kenneth DeRosa
*Attorney, Agent, or Firm*—Mason, Fenwick & Lawrence

[57] ABSTRACT

A gas storage and dispensing system is described for the substantially reversible storage of a gas. The system comprises a material (4) having open voids occupied by a liquid. The liquid is a solvent of the gas and such occupation of the open voids by the liquid, with the gas dissolved therein, forms a reversible sorption gas storage system. The system tends to sorb increasing quantities of gas in increasing ambient gas pressure and desorb previously sorbed gas with decreases in ambient gas pressure. The system may be used in a pressure pack dispenser for dispensing a product (11) under pressure of a propellent gas, where the system provides the source of pressurised propellent gas.

10 Claims, 1 Drawing Sheet

GAS STORAGE AND DISPENSING SYSTEM

This invention relates to gas storage and dispensing systems.

BACKGROUND OF THE INVENTION

There are innumerable situations in which a gas requires to be stored for subsequent release under substantially controlled conditions for practical use to be made of the physical and/or chemical properties of the gas. By way of example, stored and released gas may be employed for pressurised dispensing of a substance from a container using the gas as a propellent.

A number of practical considerations limit the substances which can be used as propellent gases and/or the circumstances in which a given substance can be used as a propellent gas. By way of non-limiting examples, such considerations include the ability to sustain pressure within acceptable limits during use, safety factors which include flammability and toxicity of the propellent, and chemical reactivity of the propellent with the container and, mainly in the case of non-barrier dispensers, reactivity of the propellent with the product to be dispensed. By way of a non-limiting example of the circumstances affecting use of a substance as a propellent gas in a non-barrier dispenser, the substance may be substantially inert with respect to one product but react unfavourably with another product (unless isolated by a barrier).

For many years the substances collectively known as CFC's (chlorofluorocarbons) were popular for use as propellents in pressure pack dispensers owing to favourable pressure characteristics combined with non-flammability and apparent non-toxicity, but CFC's are now perceived as extreme environmental hazards and are the subject of international sanctions; CFC's are no longer acceptable as propellent substances in pressure pack dispensers. Although some readily available gases are free of hazards and are substantially unreactive (for example, nitrogen), gases per se are generally unsuitable for use as propellents in pressure pack dispensers because of unacceptably rapid fall-off of propellent pressure during use of the pressure pack dispenser. Elaborations of construction and use may reduce the unwanted effects of these adverse pressure characteristics, but at the expense of increased complexity and cost, and possibly an increased hazard arising from increased initial internal pressure in the pressure pack dispenser.

Two-phase gas/liquid pressure pack propellent systems may give more acceptable pressure characteristics in terms of an acceptably low fall-off of propellent pressure during use of the pressure pack dispenser, in comparison to a single-phase gas-only system, where the liquid in a two-phase gas/liquid pressure pack propellent system is a pressure-liquefied form of the propellent gas. However the requisite pressure at ambient temperature may be unacceptably high in the context of conventional pressure pack dispensers; additional or alternative disadvantages of two-phase gas/liquefied-gas propellent systems are that they tend to employ gases which are flammable and potential substances of abuse, such as propane, butane and propane/butane mixtures. (It should be noted that such two-phase gas/liquefied gas propellent systems are essentially single-material propellent systems, where the single propellent material is present in both gas and liquid phases; this single material nature is not altered by the propellent being a mixture such as butane and propane, since the components of such mixtures change phase together, and a chemically distinct liquid is not present in such systems.)

To summarise the main considerations for the adoption of a given propellent system in a pressure pack dispenser, the propellent system should be:

(a) free of toxicity over any length of time and in any feasible concentration;

(b) free of environmental hazard over any length of time;

(c) free of other hazards, including but not restricted to hazards of fire and explosion;

(d) maintain adequate dispensing pressure on the product throughout use of the pressure pack dispenser, without excessive pressure at any time;

(e) at least in non-barrier dispensers, be compatible, and preferably non-reactive, with the product to be dispensed; and (f) be reasonably economic.

The above list of desiderata for a propellent system is only a general indication and is in no way definitive to the exclusion of any other factors; further, the desiderata are not mutually exclusive in the sense that a characteristic of a selected propellent may satisfy two or more desiderata simultaneously (for example, a hypothetical inert substance may be both non-toxic and non-flammable, as in the case of nitrogen).

SUMMARY OF THE INVENTION

According to a first aspect of the present invention there is provided a gas storage and dispensing system for the substantially reversible storage of a gas, said gas storage and dispensing system comprising a material having open voids occupied by a liquid which is a solvent of the gas, such occupation of the open voids by the liquid with the gas dissolved therein forming a reversible sorption gas storage system which will tend to sorb increasing quantities of gas in increasing ambient gas pressure, and tend to desorb previously sorbed gas with decreases in ambient gas pressure.

The material may be a porous material, for example a foam such as a polymeric foam, having an open pore structure and in this example the open voids comprise the pores of the material. Alternatively, the material may comprise a fibrous material wherein the open voids comprise the spaces between the fibres of the material.

Preferably, the material is a solid and the material will in general be a non-rigid solid, preferably with substantially elastic mechanical properties, and the total mass of the material involved in any given gas storage system may be mechanically subdivided into a substantial plurality of fragments. However, it is possible the material could be a liquid-type foam or other suitable liquid-type material.

Without prejudice to the generality of the definitions of the present invention, it is believed that the open voids in the material function as small scale stores for the liquid solvent of the gas, said material functions as a form of "sponge" which indirectly holds the gas by the gas being in solution in the liquid. The analogy to a sponge is supported by the tendency of certain suitable materials (detailed below) to swell when storing gas, where a liquid is also present.

Throughout the general and specific description of the present invention, references to "gas" and to "propellent gas" include elemental gases which may be atomic (for example, argon) or molecular (for example, nitrogen) and further include gaseous compounds (for example, carbon dioxide), or any mixture of such gases; whatever the physical form of a gas when sorbed, it is substantially gaseous when desorbed in contexts where the potential energy of the desorbed gas is required to be converted to useful mechanical work by any known thermodynamic principle, for example by adiabatic or isothermal expansion of an initially pressurised gas. Where references are made below to "propellent gas" and unless the context otherwise prohibits, these should be taken as referring also to reversibly stored gas which is for non-propellent use (for example, as a fuel gas). A preferred form of the material consists of granulated upholstery-grade polymeric foams (which may be recycled scrap foam), which granulated foams are preferably bound into a coherent mass by a polystyrene adhesive, which is itself preferably foamed. Typically, the foam is a 91b density Reconstituted Chip Foam.

The material may be treated with a swelling promoter to enhance the gas sorption capacity of the material. Further, while in certain respects, most liquids can be considered as solvents for one or more gases, at least to a limited extent, a liquid solvent for a gas should preferably dissolve a substantial amount of the selected propellent gas (or gas mixture) within the range of pressures at which the gas storage system is intended to work, but substantially without dissolution or other disruptive effect on the material, and preferably without any substantive effect beyond swelling (if any) of the material. Moreover, such a liquid solvent for a gas should also meet most or all of the principle desiderata listed above in respect of propellent systems in pressure pack dispensers, including non-toxicity and lack of environmental hazard. Preferably, the liquid is acetone where the gas is carbon dioxide and the above polymeric foam is used. However, in certain other embodiments it may be possible to use water or any other suitable liquid which may be a polar solvent.

The liquid may comprise a single compound, or a mixture of compounds. The liquid solvent may also admixed with a gas sorption promoter.

A preferred liquid is acetone for the reversible sorption of carbon dioxide or of a propellent gas mixture comprising carbon dioxide and in this example the material preferably comprises 91b density reconstituted chip foam. It is possible that the acetone may be admixed with a promoter of carbon dioxide sorption; additionally or alternatively, the acetone may be mixed with one or more other liquid solvents of carbon dioxide and/or of other components of a propellent gas mixture comprising carbon dioxide.

Alternatively or in addition, the propellent gas could comprise nitrogen or oxygen combined with a suitable liquid solvent, or indeed any other gas with an appropriate liquid.

The gas in addition or as an alternative, to being a propellent gas, could be a fuel gas, an oxidiser, an inflation gas, or a breathing gas or a breathing gas mixture.

According to a second aspect of the present invention, there is provided a pressure pack dispenser for dispensing a product therefrom by means of the pressure of a propellent gas within the dispenser, said pressure pack dispenser comprising a pressurisable container having a valve for releasing the product from the container, said container enclosing a gas storage and dispensing system according to the first aspect of the invention, for providing a source of pressurised propellent gas for dispensing the product from the pressure pack dispenser.

The pressure pack dispenser according to the second aspect of the invention may comprise a non-barrier dispenser in which the propellent gas is permitted to come into direct contact with the product to be dispensed.

Preferably however, the pressure pack dispenser according to the second aspect of the invention further comprises a barrier located between the product to be dispensed and the gas storage and dispensing system, the barrier being such as to transmit the pressure of the propellent gas to the product while preventing (or substantially preventing) direct contact between the product and the components of the propellent gas storage and dispensing system.

The barrier may comprise a flexible bag enclosing one of the product to be dispensed and the gas storage and dispensing system and sealed to the pressurisable container at or adjacent to the valve; alternatively, the barrier may comprise a piston or piston-form arrangement slidingly sealed to a substantially cylindrical internal surface of the pressurisable container with the product contained between one side of the piston or piston-form arrangement and the valve, the gas storage and dispensing system being housed between the other side of the piston or piston-form arrangement and the non-valve end of the pressurisable container such that the pressure of the propellent gas will tend, in use of the dispenser, to drive the piston or piston-form arrangement towards the valve end of the pressurisable container so as to tend to discharge the product through the valve.

Typically, the barrier is substantially impermeable to the propellent gas. However the barrier could comprise a semi-permeable barrier enclosing one of the gas storage and dispensing system and the product, the semi-permeable barrier being micro-porous or otherwise formed to be permeable to propellent gas but impermeable (or substantially impermeable) to the open void material and to the liquid solvent whereby the semi-permeable barrier passes the propellent gas to pressurise the product by direct contact while maintaining the remaining component or components of the gas storage and dispensing system out of direct contact with the product. The semi-permeable barrier may be in the form of a bag or envelope sealed in liquid-tight manner around the open-void material and the solvent; the bag or envelope may be loose or loosely anchored within the initial mass of product to be dispensed.

According to a third aspect of the present invention, there is provided a procedure for pressurising a pressure pack dispenser in accordance with the second aspect of the present invention said procedure comprising the steps of inserting a substantially predetermined quantity of a material having open voids into the pressurisable container, adding a substantially predetermined amount of a propellent in a non-gaseous form, and sealing the pressurisable container.

The substantially non-gaseous form of the propellent gas may comprise the propellent gas cryogenically cooled to a temperature at which the propellent gas is liquefied or solidified; in the particular case of carbon dioxide, solid carbon dioxide is preferred. Where the propellent gas is solidified, the solidified gas is preferably pelletised or in particulate form for greater ease of separating and metering the substantially predetermined amount of propellent gas from a bulk supply thereof. The polymeric material may be in a unitary mass or be pelletised or in particulate form for greater ease of separating and metering the substantially predetermined quantity thereof into the pressurisable container.

However, preferably the non-gaseous form of the propellent gas comprises the propellent gas dissolved in the liquid under pressure. In the case of carbon dioxide and acetone this is between 100 p.s.i. to 250 p.s.i. and preferably the amounts are chosen so that the final container pressure does not fall below 40 p.s.i. when the container has been emptied of product and preferably does not fall below 55 p.s.i. Typically, the pressure drop between a full and empty container is less than 60 p.s.i.

A significant advantage of the pressurising procedure according to the third aspect of the present invention lies in the ability to load the dispenser with the essential components of the propellent gas storage and dispensing system at ambient atmospheric pressure, with the subsequent thawing and boiling of the initially non-gaseous form of the propellent gas giving rise to the essential gaseous pressure of the propellent.

The product may have been inserted into the pressurisable container, on the valve side of the piston or the piston-form arrangement, prior to the above-described pressurising procedure, either by backfilling through the valve after fitting of the pressurisable container with the piston or the piston-form arrangement, or by insertion of the product into the pressurisable container through the open non-valve end of the container prior to fitting of the piston or the piston-form arrangement; alternatively the product may be inserted into the pressurisable container subsequent to the above-described pressurising procedure, and preferably also subsequent to post-pressurisation safety checks and quality assurance, by backfilling through the valve against whatever pressure has developed on the opposite side of the piston or the piston-form arrangement. Loading of the pressurisable container with the product to be dispensed may utilise the method described in British Patent Specification GB2032006.

BRIEF DESCRIPTION OF THE DRAWINGS

Examples of a reversible gas storage system in accordance with the invention will now be described by way of example, with reference to the accompanying drawings in which.

DESCRIPTION OF PREFERRED EMBODIMENTS

Offcuts and scraps of polymeric foam from the upholstery industry were cut into "chips" or granules, and formed into a unitary mass by admixture with a polystyrene adhesive, to form a polymeric foam having an open pore structure and a nine pound density. This type of foam is commonly known as an open cell, 91b density reconstituted chip foam. From the unitary mass, discs were cut with a diameter of about 37 millimeters and an axial thickness of about 16 millimeters. Each disc was further sub-divided into two parts by a coaxial cut through its complete thickness, to form a 27 millimeter diameter central disc shaped "hub" surrounded by a uniform annulus of about 5 millimeters radial thickness, the annulus initially being left in place on the "hub".

Figure 1:
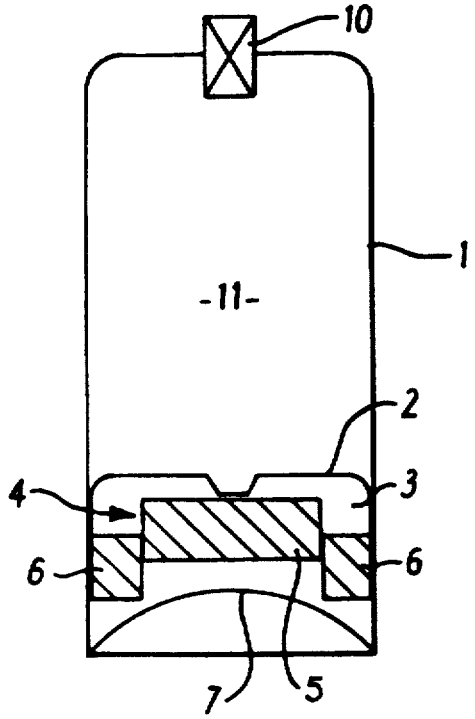
FIG. 1 shows a first example of a pressurised container having a reversible gas storage system; and, FIG. 2 shows a second example of a pressurised container.

A pressure-pack dispenser container 1 is provided (see FIG. 1) having an outlet valve 10 for dispensing a product 11 from the container 1. The container 1 initially minus its bottom closure 7 and empty of dispensable product 11 was inverted. A barrier piston 2 having a central recess 3 was inserted into the inverted empty container, followed by a two-part foam disc 4 as described in the preceding paragraph, the foam disc being aligned to lie flat on the underside of the piston 2. A measured quantity of liquid acetone (see numerical examples below) was then added, so as to soak the foam disc 4 while minimising free liquid acetone not soaked up by the foam. The container is a hollow cylinder having a diameter such that when the foam has swollen it is in contact with the interior side walls of the container. The acetone-soaked disc was then manipulated to press the hub 5 into the hollow recess of the piston but without pulling the annulus 6 off the hub 5, to form a shallow cup whose bowl comprised the upper face of the hub 5 surrounded by the annulus 6, as shown in FIG. 1. A measured quantity of granulated solid-frozen carbon dioxide (see numerical examples below) was then placed in the bowl of the cup formed by the acetone-soaked form disc, the container base 7 next being promptly located on the open lower end of the inverted dispenser container and sealed thereto.

As the carbon dioxide evaporated within the now-sealed propellent chamber of the pressure-pack dispenser, the carbon dioxide became dissolved in the acetone, which liquid was dispersed over the internal surfaces of the open voids formed by the open porous structure of the foam of the disc. When the total contents (foam, acetone, and initially orgogenic carbon dioxide) of the propellent chamber warmed to and stabilised at ambient temperature, the resultant combination formed a three-phase reversible sorption propellent gas storage and dispensing system with the carbon dioxide reversibly dissolved in the acetone, and the gas/liquid mixture having a relatively high surface area (compared to a foamless two-phase gas/liquid system) due to being spread over the substantial surface area provided by the open-void structure of the foam.

Various possible quantitative variations in the proportions of acetone and carbon dioxide will now be described, along with the operative pressure ranges at ambient indoor temperature (i.e. the higher propellent pressure at the commencement of product dispensing, and the lower propellent pressure at product exhaustion). It is to be noted that provided a certain minimum terminal propellent pressure obtains at product exhaustion, a relatively lower pressure range indicates a relatively superior performance of the propellent system in terms of lower propellent pressure variation and lower peak pressure. (In the following examples, the terminal pressure was selected be approximately 55 psi (pounds square inch) in all cases, as being adequately above the 40 psi pr thereabouts at which carbon dioxide dissolves under pressure in acetone).

| Example | acetone (grammes) | carbon dioxide (grammes) | peak pressure (psi) |
|---|---|---|---|
| No 1 | 7.4 | 2.8 | 110 |
| No 2 | 10.0 | 3.0 | 106 |
| No 3 | 12.6 | 3.2 | 102 |
| No 4 | 14.9 | 3.2 | 95 |
| No 5 | 21.9 | 3.7 | 89 |
| No 6 | 26.5 | 4.0 | 84 |
| No 7 | 30.7 | 4.2 | 80 |
| No 8 | 42.3 | 4.9 | 75 |

It will be observed that performance (in terms of lower pressure range and lower peak pressure) improved from the quantities of example No 1 progressively up to Examples No 8, but at the expense of requiring progressively increasing quantities of material to achieve such performance. Moreover the quantity of acetone in Example No 8 exceeded the liquid-holding capacity of a single foam disc.

Provided the foam disc could be held flat and not tipped on edge, its liquid-holding capacity was maximised, and the pressure performance of the propellent system was not reduced by loss of liquid acetone from the foam.

Figure 2:
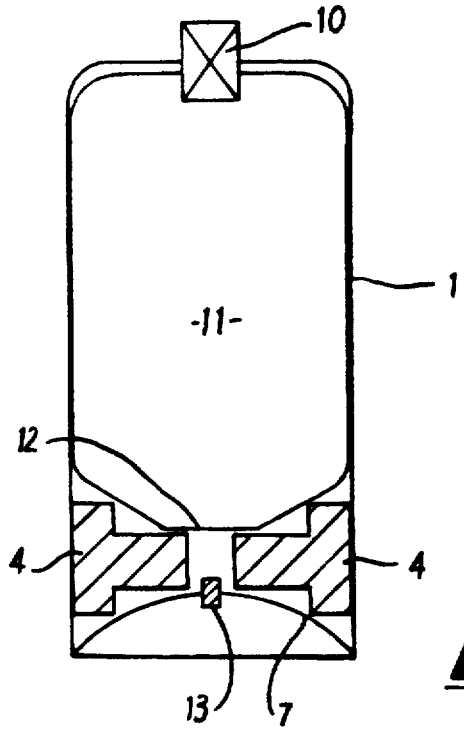

Ideally, the entire space between the barrier and the base 7 of the container is filled with foam. However, one practical solution to this ideal condition is shown in FIG. 2 where it can be seen that the shaped foam 4 extends into the recesses between the walls of the container 1 and the base 7. This minimises the volume of liquid acetone lying in the recess due to the wicking effect of the foam and the depth to which the foam penetrates into the recesses.

In the example shown in FIG. 2 the barrier between the product 11 and the propellent chamber is formed by a plastic bag 12 which contains the product 11. The foam 4 is placed adjacent to the plastic bag and then the base 7 (without plug 13) is fixed onto the container 1. At a later time the propellent gas in solution with the liquid, for example carbon dioxide dissolved in acetone at a pressure of 225 psi by bubbling carbon dioxide at this pressure through the acetone, may be inserted into the container 1 through an aperture in the base 7 which is then subsequently sealed by a plug 13. The solution of acetone and carbon dioxide is absorbed into the foam 4, causing the foam to swell and to adopt the position shown in FIG. 2.

By using this method of pressurising the container it is easier to regulate the concentrations and volumes of acetone and carbon dioxide delivered into the propellent chamber.

In puncturing tests on a pressure-pack dispenser loaded with propellent as described above, the puncture into the loaded propellent chamber released a stream of substantially non-inflammable 95% carbon dioxide 5% acetone in the case of an unused dispenser and 89% carbon dioxide 11% acetone in the case of an exhausted dispenser. This demonstrates the safety of the present invention in relation to an acetone/carbon dioxide propellent system not employing an open-pre foam or other open-void material, wherein a comparative puncturing test released a highly inflammable stream of almost pure liquid acetone.

As alternatives to the use of a polymeric foam as described above, use could be made of fibrous material, either natural or synthetic fibres (or a mixture of these), e.g. an appropriately sized mass of cotton wool (compacted unspun cotton staple). The spaces between the fibres in such fibrous material constitute the open voids of this form of the material for carrying the invention.

Without prejudice to the scope of the invention, it is theorised that the beneficial affects of utilising an open-void material arise from an induced increase in the Oswald Coefficient, from 6.5 in the two-phase gas/liquid acetone/carbon dioxide of the prior art, up to about 9 in the three-phase gas/liquid/open-void solid acetone/carbon dioxide in the above-exemplified form of the invention. The very open-void material is believed to spread out the gas-containing liquid solvent, and so improve the speed of gas release upon partial depression.

While certain modifications and variations have been described above, the invention is not restricted thereto, and other modifications and variations can be adopted without departing from the scope of the invention.

I claim:

1. A pressure pack dispenser for dispensing a product therefrom by means of pressure of a propellant gas within the dispenser, the pressure pack dispenser comprising:

a pressurizable container having a valve for dispensing product from the container and a barrier which divides the container into a product chamber and a propellant chamber, the propellant chamber enclosing a gas storage and dispensing system for the substantially reversible storage of the propellant gas;

the gas storage and dispensing system comprising:

a material having open voids;

a liquid which occupies the open voids in said material; and a propellant gas, the liquid being a solvent of the propellant gas;

wherein said liquid in said gas storage and dispensing system sorbs increasing quantities of propellant gas in increasing ambient gas pressure and desorbs previously sorbed gas in decreasing ambient gas pressure, said gas storage and dispensing system providing a source of the pressurized propellant gas; wherein said barrier transmits the pressure of the propellant gas to the product in order to dispense the product from the pressure pack dispenser and wherein said barrier is substantially impermeable to the nongaseous components of said gas storage and dispensing system.

2. A pressure pack dispenser according to claim 1, wherein the material comprises a porous material.

3. A pressure pack dispenser according to claim 2, wherein the porous material is an open pore structure.

4. A pressure pack dispenser according to claim 2, wherein the porous material comprises a foam.

5. A pressure pack dispenser according to claim 4, wherein the foam comprises a polymeric foam.

6. A pressure pack dispenser according to claim 1, wherein the material comprises a fibrous material and the open voids are provided by spaces between the fibres of the material.

7. A pressure pack dispenser according to claim 1, wherein the material is a solid.

8. A pressure pack dispenser according to claim 1, wherein the material is treated with a swelling promoter to enhance the gas sorption capacity of the material.

9. A pressure pack dispenser according to claim 1, wherein the barrier is substantially impermeable to the propellant gas.

10. A pressure pack dispenser according to claim 1, wherein the barrier comprises a flexible bag mounted within the container, the bag enclosing one of the gas storage and dispensing system and the product.

* * * * *